US006809705B1

(12) United States Patent
Sase

(10) Patent No.: US 6,809,705 B1
(45) Date of Patent: Oct. 26, 2004

(54) SMALL-SIZED ELECTRONIC EQUIPMENT

(75) Inventor: Masahiro Sase, Fussa (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/319,032

(22) PCT Filed: Sep. 30, 1998

(86) PCT No.: PCT/JP98/04404

§ 371 (c)(1),
(2), (4) Date: May 28, 1999

(87) PCT Pub. No.: WO99/17174

PCT Pub. Date: Apr. 8, 1999

(30) Foreign Application Priority Data

Oct. 1, 1997 (JP) ..... 9-268310

(51) Int. Cl.[7] ..... G09G 5/00
(52) U.S. Cl. ..... 345/5; 345/87
(58) Field of Search ..... 345/40, 87, 4, 345/5, 6; 368/76; 349/77

(56) References Cited

U.S. PATENT DOCUMENTS 3,820,108 A * 6/1974 Luce ..... 326/108
3,950,078 A * 4/1976 Zatsky ..... 349/113
4,009,938 A * 3/1977 Yamazaki et al. ..... 349/186
4,059,955 A * 11/1977 Prak ..... 368/188
4,247,930 A * 1/1981 Martin ..... 368/84
5,115,228 A * 5/1992 Harris et al. ..... 345/5
5,255,087 A * 10/1993 Nakamura et al. ..... 348/164
5,404,341 A * 4/1995 Horiguchi ..... 368/110
5,499,053 A * 3/1996 Itoh ..... 348/333
5,619,266 A * 4/1997 Tomita et al. ..... 348/363
5,684,551 A * 11/1997 Nakamura et al. ..... 349/99
5,847,789 A * 12/1998 Nakamura et al. ..... 349/99
5,903,785 A * 5/1999 Ishiguro et al. ..... 396/277
6,028,656 A * 2/2000 Buhrer et al. ..... 349/196
6,147,934 A * 11/2000 Arikawa et al. ..... 368/84

FOREIGN PATENT DOCUMENTS

JP 11-84370 3/1999
JP 11-101976 4/1999

* cited by examiner

*Primary Examiner*—Xiao Wu
*Assistant Examiner*—Kevin M. Nguyen
(74) *Attorney, Agent, or Firm*—Dickstein Shapiro Morin & Oshinsky LLP

(57) ABSTRACT

The power consumption of small electronic device having a display opening/closing shutter is lowered. A display shutout control means (10) is provided to stop the operation of a display drive means (60) according to the control made by the display shutout control means (10) in a display shutout state to save power.

14 Claims, 10 Drawing Sheets

SMALL-SIZED ELECTRONIC EQUIPMENT

TECHNICAL FIELD

The present invention relates to opening/closing control of a shutter for switching between an information display state and a display shutout state of, for example, a liquid crystal display panel as an information display section of small electronic device, and more particularly to technology for reducing the power consumption of an entire system in a display shutout state.

BACKGROUND ART

An opening/closing shutter device for opening and closing an information display section of small electronic device such as a wrist-watch into an information display state and a display shutout state is conventionally available on the market, but such devices mostly employ a mechanical structure. Even if electronics is employed, a complex link mechanism is driven by a motor as a drive source, and an opening/closing shutter is opened and closed by a complex switch mechanism as an operating member for controlling opening and closing.

However, the opening/closing shutter device of the conventional small electronic device described above drives the complex link mechanism by the motor as the drive source and opens and closes the opening/closing shutter by the complex switch mechanism as the control member for the opening/closing control and requires a high power consumption. Especially, when the opening/closing shutter device is adopted for a wrist-watch and put on an arm, the opening/closing shutter device is positioned at the upper part of the wrist-watch body. Therefore, the watch is large in thickness, heavy and not easily fitted on an arm. It is also necessary to decrease the power consumption because such a small electronic device as a wrist-watch is limited to using a small button type battery.

The present invention was achieved in order to remedy the problems described above. It is an object of the invention to provide a small electronic device having a small and lightweight opening/closing shutter, the system as a whole having small power consumption.

DISCLOSURE OF THE INVENTION

In order to achieve the above-object, the small electronic device according to the present invention comprises an information generating means, a display drive means for outputting a display drive signal according to a signal from the information generating means, and a display device for displaying information according to an output signal from the display drive means, which is characterized by a display shutout control means for switching between a display state of the display device displaying information and a display shutout state where the information display by the display device is not visible, a shutter means which is driven by the display shutout control means to form a display shutout state, and the display drive means which stops the operation according to the control by the display shutout control means in the display shutout state.

Thus, the small electronic device provided with a display opening/closing shutter can be realized, which can lower the power consumption of the entire system by stopping the operation of the display drive means in the display shutout state and can be fitted on an arm.

A quite high power saving effect can be obtained by setting control time for switching from the information display state to the display shutout state of the display device as desired and stopping the operation of the display drive means in the display shutout state excepting a few seconds of the information display state during which the shutter is kept open.

The shutter means can be a liquid crystal shutter means using liquid crystal, which has the shutter means mounted in the display device. Thus, a power saving effect can be further improved.

A reflective polarizing plate can also be used for the liquid crystal shutter means.

Thus, a display section of the display device in the display shutout state can have a metallic luster by the incident light from an external light source, and display can be carried out in various ways.

Sensing can be carried out by a variety of sensing methods by controlling the display shutout control means in accordance with a signal from the switch means and using a sensor switch in addition to a manual switch for the switch means. It is also possible to use a switch means which is turned on upon receiving a radio signal from a pager or the like.

Information of the information generating means is determined as time information, and the information display section provided on the display device can easily employ the display form of an analog watch with rotating hands for displaying time information according to the time information from the information generating means.

The small electronic equipment is further provided with information restoring means for controlling elapsed time information on the display shutout state between the display shutout state and the time information display state, and the information restoring means is configured to restore the hands of the pointer type watch to the present time according to the elapsed time information in the information restoring means upon restoring to the time information display state, so that a delay caused by the stop of the analog watch can be automatically restored to correct time.

According to the control carried out by the display shutout control means, the information restoring means starts counting when the time information display state is switched to the display shutout state and keeps the counted value obtained when the counting operation is stopped as elapsed time information upon returning to the time information display state, produces a restoration drive signal for effecting the restoring drive according to the counted value, supplies the restoration drive signal to the display drive means, and automatically returns a delay caused due to the stopping of the analog watch to correct time.

The restoration drive signal can quickly restore the analog watch to the correct time as a fast forwarding drive signal having an appearance cycle faster than that of an ordinary drive signal.

BEST MODE FOR CARRYING OUT THE INVENTION

Embodiments of the invention will be described with reference to the drawings.

Figure 1:
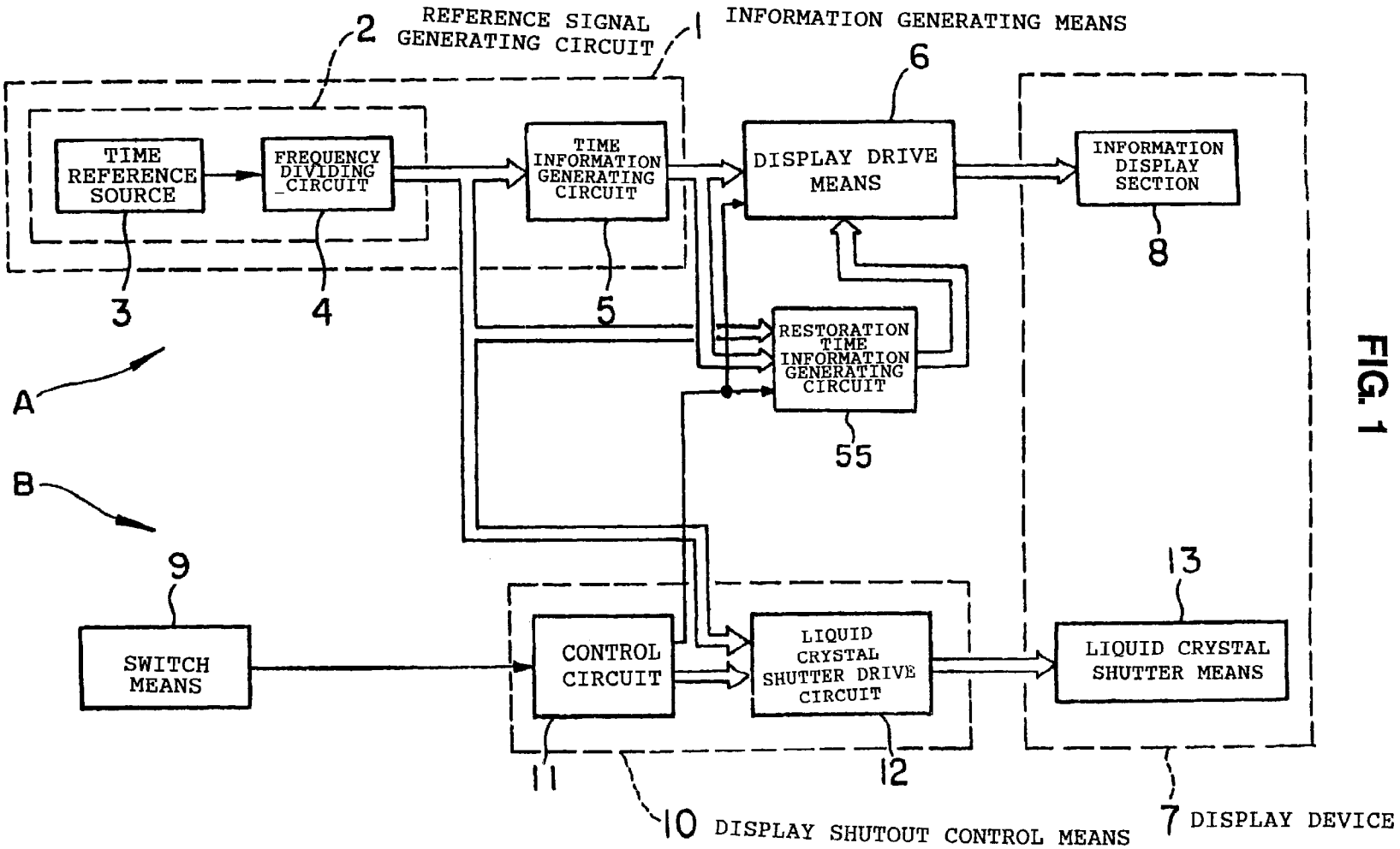
FIG. 1 is a system block diagram of a first embodiment of small electronic device according to the invention.
Figure 2:
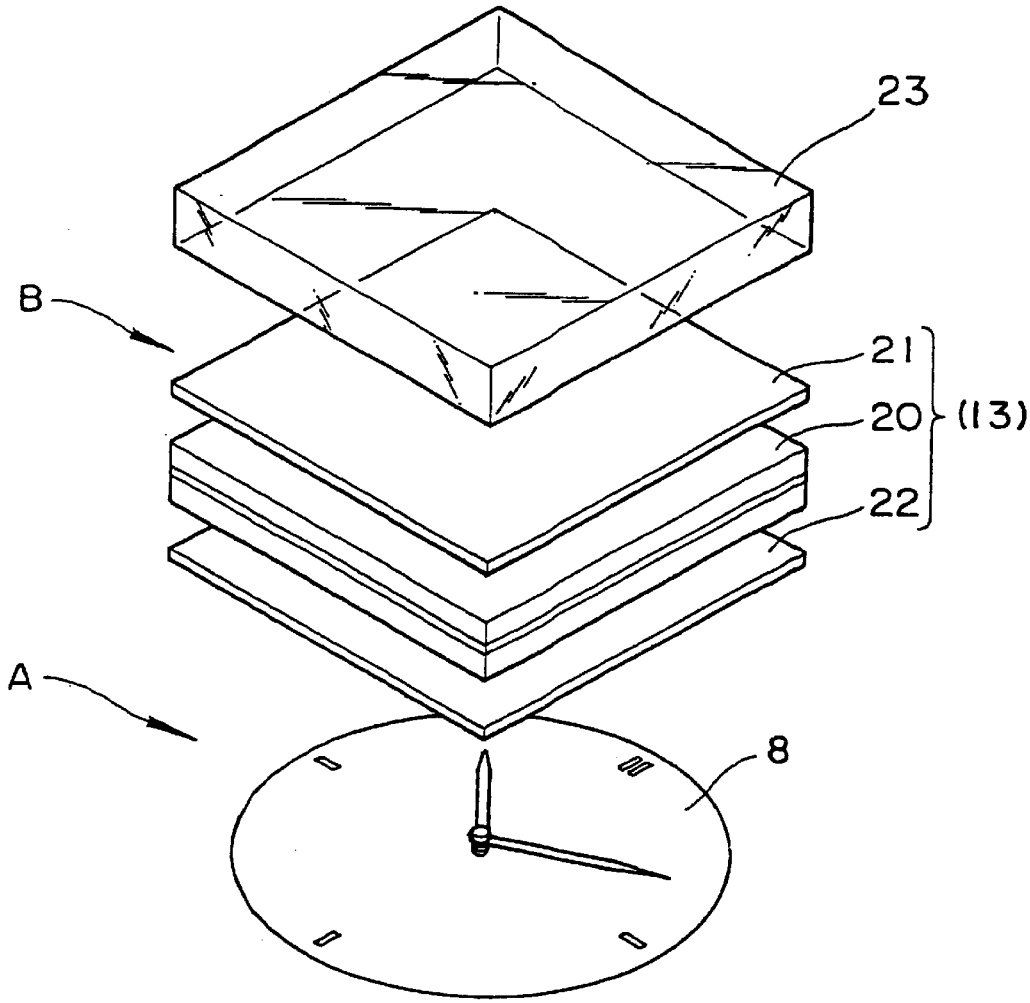
FIG. 2 is a perspective diagram schematically showing the structure of a display section of the small electronic device of FIG. 1.

A first embodiment of small electronic device according to the present invention is shown in FIG. 1 and FIG. 2.

FIG. 1 is a system block diagram showing the first embodiment of the small electronic device according to the invention, and FIG. 2 is a perspective diagram schematically showing the structure of a display section of the small electronic device.

The first embodiment of the small electronic equipment according to the invention will be described with reference to an analog quartz watch A. In FIG. 1, information generating means 1 comprises a reference signal generating circuit 2 and a time information generating circuit 5, and the reference signal generating circuit 2 further comprises a time reference source 3 and a frequency dividing circuit 4. The time reference source 3 generates a time reference signal (32768 Hz). The frequency dividing circuit 4 comprises a plurality of frequency dividers with the time reference signal entered from the time reference source 3 and outputs a signal group of predetermined reference signals.

The time information generating circuit 5 outputs a one-minute step signal (normal drive signal), which is a time signal, according to a predetermined reference signal from the reference signal generating circuit 2. In an information display state, a display drive means 6 which is a motor drive circuit outputs a one-minute drive signal according to the one-minute step signal. An information display section 8 of a display device 7 comprises a pulse motor, a gear train synchronized with the pulse motor and hands (hour and minute hands) connected to the gear train and, in the information display state, it displays the operation of the hands according to the one-minute drive signal.

Figure 10:
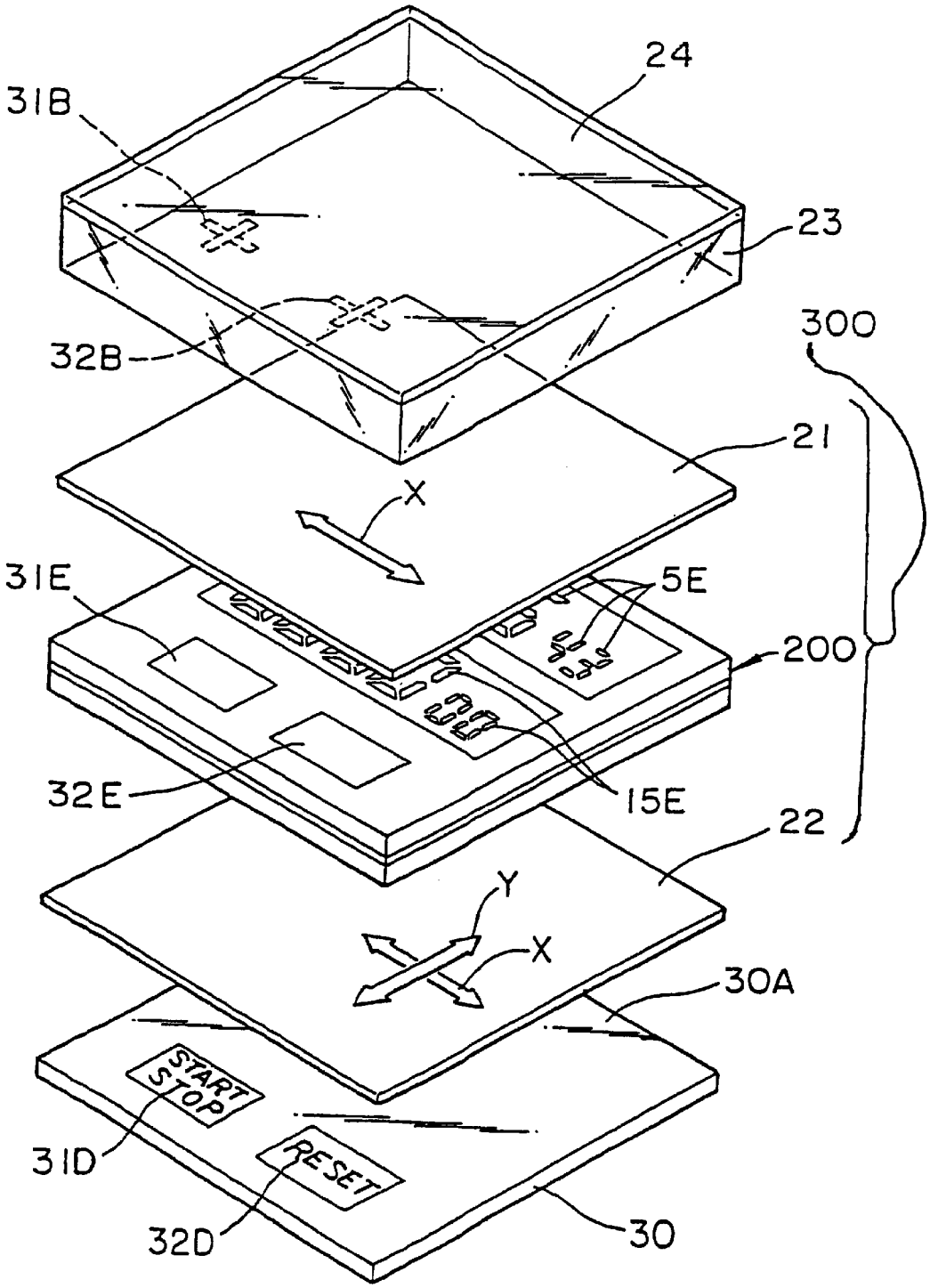
FIG. 10 is a perspective diagram schematically showing the structure of the display section of the fourth embodiment of the small electronic device of FIG. 8.

A liquid crystal shutter means 13, which is a shutter means made of a liquid crystal panel of a shutter section B which is formed integral with or separate from the information display section 8 of the display device 7 of the watch A configured as described above, has an absorptive polarizing plate 21 and a reflective polarizing plate 22 laminated with a liquid crystal cell 20 held therebetween as shown in FIG. 2 (exploded view). Glass 23 is fitted above the liquid crystal shutter means 13. As shown in FIG. 10 of a fourth embodiment to be described later, the absorptive polarizing plate 21 is an absorptive polarizing plate having one polarizing axis which is transmission axis X and the other which is an absorption axis. The reflective polarizing plate 22 is a reflective polarizing plate having one polarizing axis which is transmission axis X and the other which is reflection axis Y. The reflective polarizing plate actually used in this embodiment is an optical film DBEF (a tradename) manufactured by Sumitomo 3M Ltd. In the laboratory, a metal grid type polarizing plate (0.2 $\mu$m pitch metal grid formed on glass), liquid crystal and a phase plate were used in a combination.

The properties of the above polarizing plate will be described in a state excluding the liquid crystal cell 20. When either the absorptive polarizing plate 21 or the reflective polarizing plate 22 is fixed and the other is rotated, the polarizing plate shows a transmission characteristic at an angle 0 degree such that the transmission axis X of the absorptive polarizing plate 21 is parallel to the transmission axis X of the reflective polarizing plate 22, and a high reflection strength when the reflection axis Y of the reflective polarizing plate 22 is orthogonal 90 degree to the transmission axis X of the absorptive polarizing plate 21. Therefore, a lustrous reflection characteristic is obtained by an external light source, and a shutter having a metallic luster due to the incidence of light through the glass 23 of the watch can be configured. The same effect as described above can be also obtained when the absorptive polarizing plate 21 is used as the reflective polarizing plate and the reflective polarizing plate 22 as the absorptive polarizing plate, namely both the polarizing plates are changed to an upside down position.

In order to drive the liquid crystal shutter means 13 of the shutter section B as a shutter, a switching signal from a switch means 9, which is made of, for example, a wearing detecting sensor switch, an angle (inclination) sensor switch, a touch sensor, a shock sensor, a water-sensitive sensor for detecting a water pressure or the like as shown in FIG. 1, is entered as a control signal into a display shutout control means 10 which comprises a control circuit 11 as control means for controlling shutter opening and closing and a liquid crystal shutter drive circuit 12 as liquid crystal shutter drive means for driving the shutter, and controls application of a voltage of the liquid crystal cell 20 included in the liquid crystal shutter means 13 as the shutter means for the display device 7 to effect the opening and closing of the shutter. The liquid crystal shutter drive circuit 12, to which a predetermined reference signal is supplied from the reference signal generating circuit 2, produces a shutter drive signal for driving the liquid crystal shutter means 13.

The control signal for the shutter opening and closing from the control circuit 11 of the display shutout control means 10 to the liquid crystal shutter drive circuit 12 and a power saving control signal, for executing control so as to save power of the entire system, which is output at the time of a display shutout state are output to the display drive means 6.

In the display shutout state, the power saving control signal is output, the display drive means 6 as the motor drive circuit stops operating to output the drive signal according to the power saving control signal. Thus, a time hand display on the basis of the one-minute drive signal is suspended and put into a power saving state, thereby reducing the power consumption of the entire system. In other words, the stop of the display drive means 6 as the motor drive circuit reduces the power consumption, and the stop of the time hand display also reduces the power consumption. In this state, a restoration time information generating circuit 55 to be described later counts and stores the one-minute step signal input from the time information generating circuit 5 for elapsed time during which the time hand display is suspended according to the power saving control signal from the display shutout control means 10.

The restoration time information generating circuit 55 as the information restoring means receives the predetermined reference signal from the reference signal generating circuit 2, the one-minute step signal from the time information generating circuit 5 and the power saving control signal from the control circuit 11 of the display shutout control means 10. Switching from the display shutout state to the information display state is effected by the switch means 9. Output of the power saving control signal is cut off according to the signal from the switch means 9. In order to switch from the power saving suspension mode to the normal time display mode to indicate the exact time, the restoration time information generating circuit 55 outputs a fast-forwarding step signal (fast-forwarding drive signal) with an appearance cycle of 64 Hz which is shorter than that of a normal drive signal to restore the stored elapsed time during which the time hand display was suspended.

Meanwhile, the display drive means 6 as the motor drive circuit in the information display state outputs a 64 Hz drive signal according to the fast-forwarding step signal. In the information display section 8 of the display device 7, the pulse motor, the gear train synchronized with the pulse motor and the hands (hours and times) connected to the gear train perform the fast-forwarding time hand display according to the 64 Hz drive signal to restore the exact time display.

In addition to the method which uses the restoration time information generating circuit 55 as the information restoring means, counts and stores the elapsed time and restores to the present time, a difference between a hand position counter for storing the hand positions at the time of the display shutout and the time information generating circuit 5 (or a present time counter) may be restored until both the counters match each other.

Figure 3:
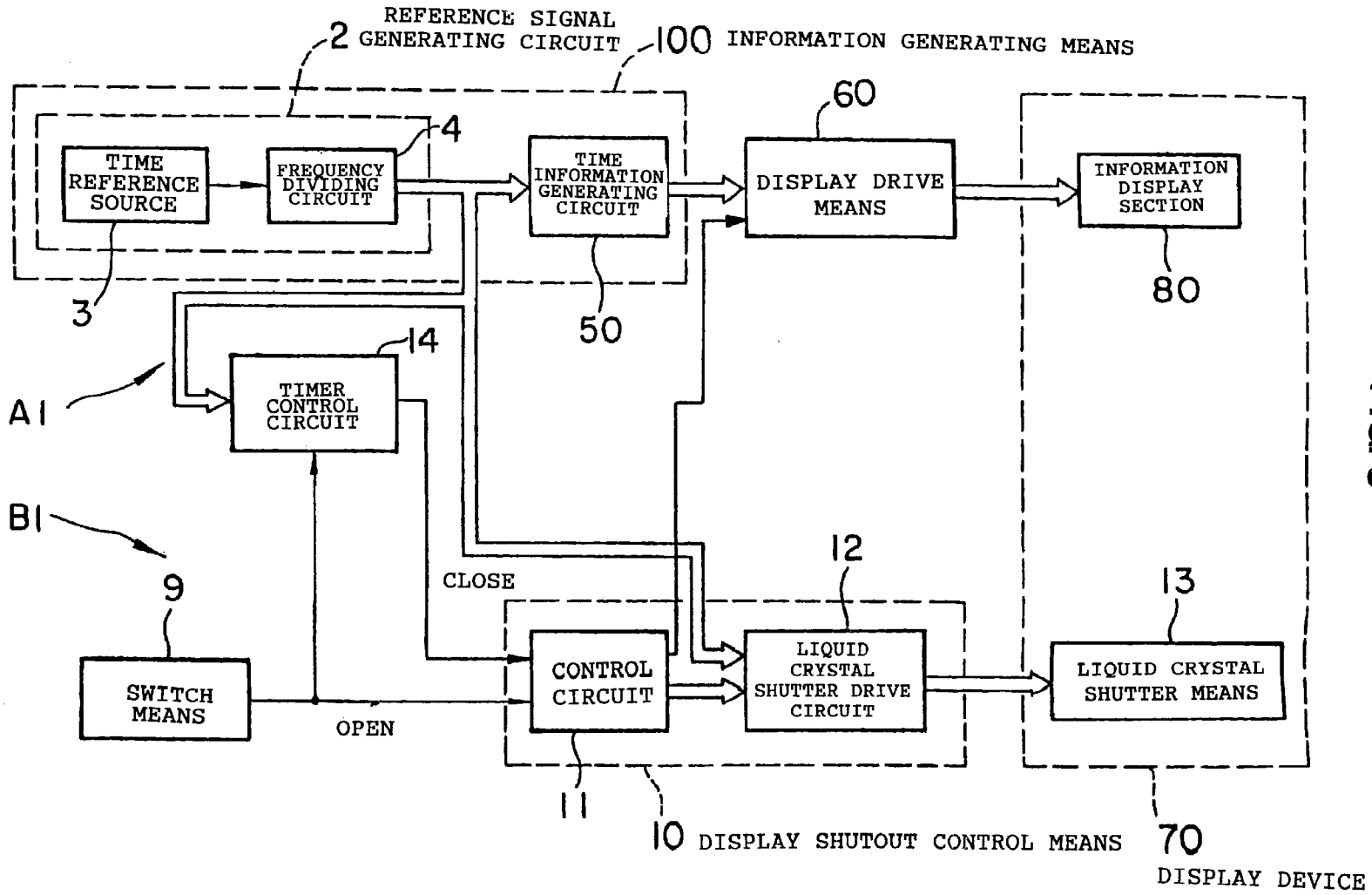
FIG. 3 is a system block diagram of a second embodiment of small electronic device according to the invention.
Figure 4:
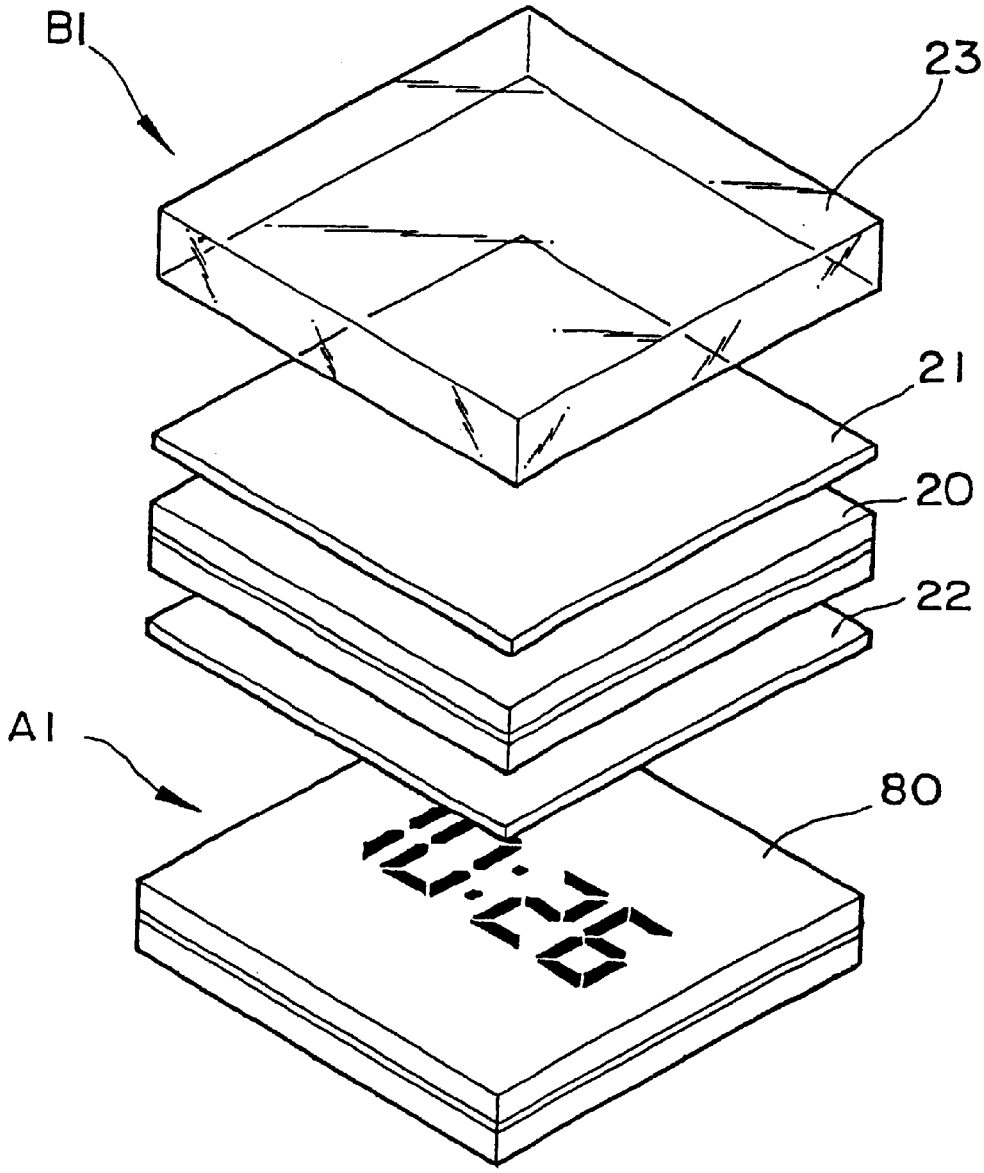
FIG. 4 is a perspective diagram schematically showing the structure of a display section of the small electronic device of FIG. 3.

FIG. 3 and FIG. 4 show a second embodiment of the small electronic device according to the present invention.

FIG. 3 is a system block diagram showing the second embodiment of the small electronic device according to the invention. FIG. 4 is a perspective diagram schematically showing the structure of a display section of the small electronic device.

The second embodiment of the small electronic device will be described with reference to a digital quartz watch A1. FIG. 3 shows substantially the same structure as that of the first embodiment excepting for a time information generating circuit 50 of an information generating means 100, a display drive means 60, an information display section 80 and a timer control circuit 14. Therefore, the same reference numerals as in the first embodiment are used and their descriptions will be omitted.

The time information generating circuit 50 as the time counter counts time to output a time signal according to a predetermined reference signal from the reference signal generating circuit 2. The display drive means 60 as the liquid crystal driver in an information display state outputs a display drive signal according to the time signal. A liquid crystal panel which is the information display section 80 in the information display state carries out a digital time display according to the display drive signal.

A liquid crystal shutter means 13 which is the liquid crystal panel of the shutter section B1 configured in the same way as in the first embodiment is mounted above the information display section 80 of the display device 70 of the watch A1 as shown in FIG. 4.

In order to drive the liquid crystal shutter means 13 of the shutter section B1, a switching signal output from the switch means 9 is input as the control signal to the display shutout control means 10, which comprises the control circuit 11 for controlling the shutter opening and closing and the liquid crystal shutter drive circuit 12 for driving the shutter, to control the application of a voltage to the liquid crystal cell 20 as the liquid crystal shutter means 13 of the display device 70 to open and close the shutter in the same way as in the first embodiment.

It is seen in FIG. 3 that the liquid crystal shutter means 13 is switched from the display shutout state to the information display state according to the switching signal from the switch means 9. The timer control circuit 14 (timer counting is started according to the switching signal from the switch means 9) which is an added component in the second embodiment and operates to carry out the timer counting control: in other words, a close signal output from the timer control circuit 14 at the elapse of a predetermined time is controlled to enter as a close signal to the display shutout control means 10, and as a signal to control the display shutout, controls the application of a voltage to the liquid crystal cell 20 of the liquid crystal shutter means 13 of the display device 70 to again shut out the display of the liquid crystal panel. Therefore, time (e.g., 5 seconds) of opening the shutter of the liquid crystal shutter means 13 can be controlled as desired by setting and inputting a desired control time (e.g., 5 seconds) to the timer control circuit 14.

The control circuit 11 of the display shutout control means 10 outputs a control signal for the shutter opening and closing to the liquid crystal shutter drive circuit 12 and the power saving control signal for controlling the power saving of the entire system output in the display shutout state to the display drive means 60.

In the display shutout state, the power saving control signal is output, the display drive means 60 as the liquid crystal driver stops the operation to output the display drive signal according to the power saving control signal, the liquid crystal displaying operation according to the display drive signal is stopped, and the power consumption of the entire system is decreased to have a power saving condition. In other words, the power consumption is decreased as the display drive means 60 as the liquid crystal driver stops, and the power consumption is also decreased as the liquid crystal displaying operation is stopped.

Depending on the usage, the signal output from the timer control circuit 14 may be an open signal, and the output from the switch means 9 may be a close signal. In either case, the timer counting operation is started by a reset (R) function or the like.

A third embodiment of the small electronic device according to the present invention will be described with reference to FIG. 5 through FIG. 7.

Figure 5:
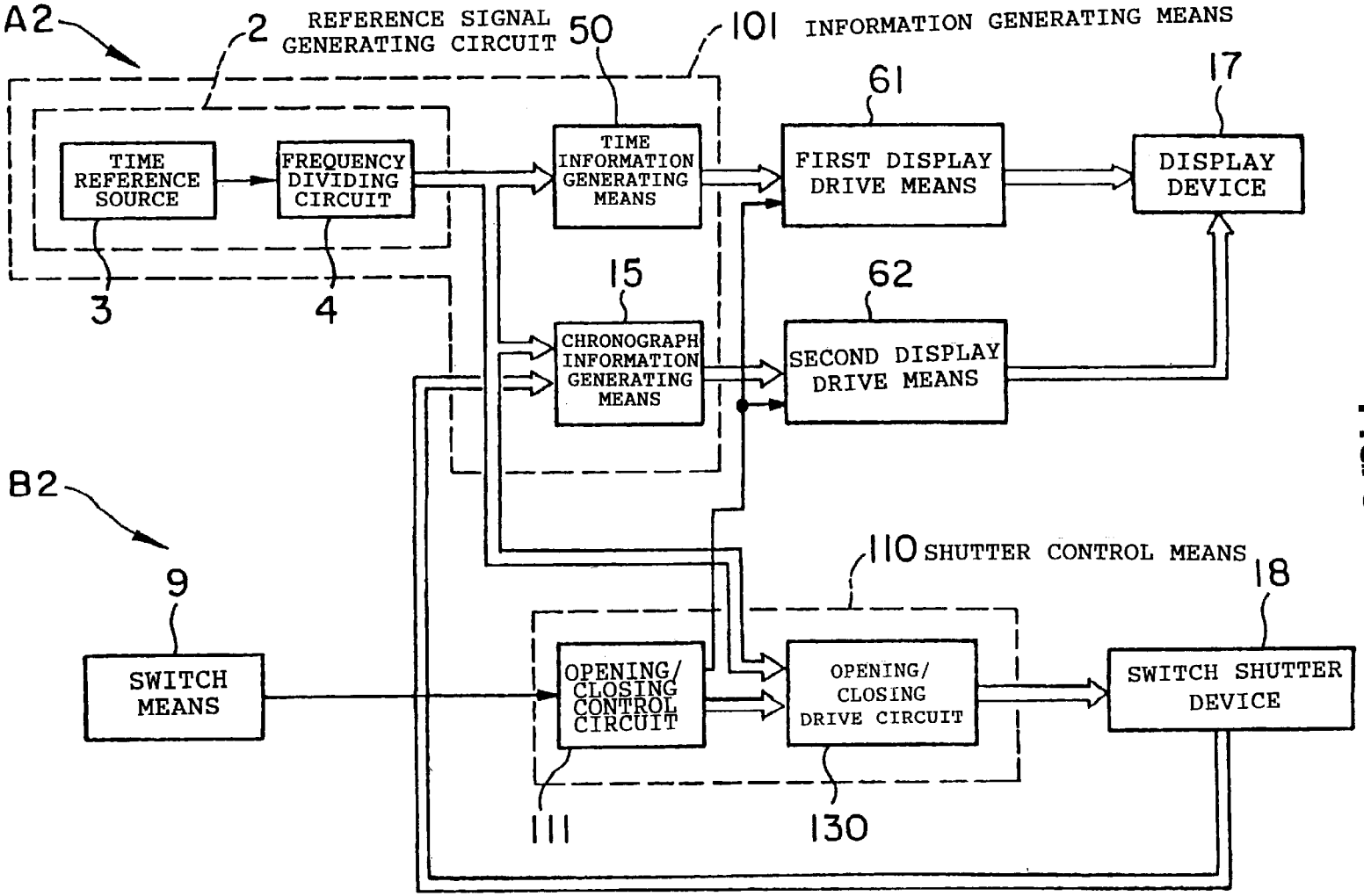
FIG. 5 is a system block diagram of a third embodiment of small electronic device according to the invention.
Figure 6:
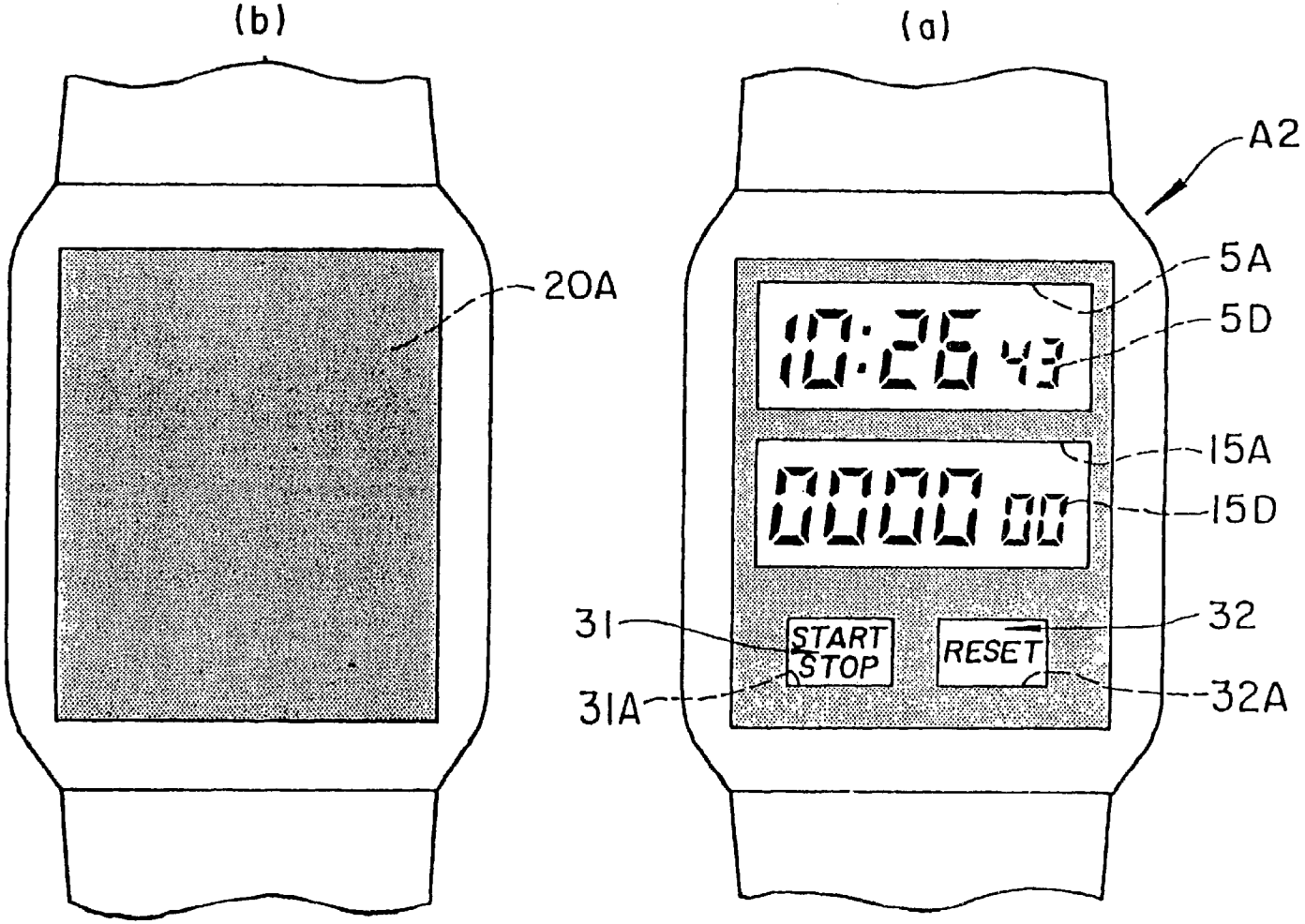
FIG. 6 is a plan diagram showing the small electronic device of FIG. 5, (a) is a plan diagram showing the device with a shutter open, and (b) is a plan diagram showing the same with the shutter closed.

FIG. 5 is a system block diagram of the third embodiment of the small electronic device according to the present invention. FIG. 6(*a*) is a plan diagram showing the small electronic device with its shutter open, FIG. 6(*b*) is a plan diagram showing the small electronic device with its shutter closed, and FIG. 7 is a perspective diagram schematically showing the structure of a display section of the small electronic device.

The third embodiment of the small electronic device will be described with reference to a digital quartz watch A2. FIG. 5 shows information generating means 101 which has the same structure as the information generating means 100 of the second embodiment except for the addition of a chronograph information generating circuit 15 to the information generating means 100 of the second embodiment, a first display drive means 61, a second display drive means 62 and a display device 17. Therefore, the same reference numerals as in the second embodiment are used and their descriptions will be omitted.

A time counter which is a time information generating circuit 50 counts time according to a predetermined reference signal from the reference signal generating circuit 2 to output a time signal. A liquid crystal driver which is a first display drive means 61 gives a display drive signal to a liquid crystal display panel 20D of the display device 17 according to the time signal. The liquid crystal display panel 20D has an absorptive polarizing plate 210 and an absorptive polarizing plate 211 laminated with a liquid crystal cell 201 held between them. Time is displayed on a time display section 5D of the liquid crystal display panel 20D.

In the same manner, the chronograph information generating circuit 15 including a chronograph counter counts chronograph measurement time to output a chronograph signal according to a predetermined reference signal from the reference signal generating circuit 2. A second display drive means 62 as the liquid crystal driver displays, according to the chronograph signal, the display drive signal on a chronograph display section 15D of the liquid crystal display panel 20D as a function of a stop-watch (chronograph) for chronograph information. The chronograph information generating circuit 15 is operated, stopped or zero reset according to an operation switch signal from a switch shutter device 18.

Operation to drive the switch shutter device 18 of the shutter section B2 as a shutter will be described below. In the same way as in the first embodiment, the switching signal output from the switch means 9 is input as a control signal to a shutter control means 110 as display shutout control means comprising an opening/closing control circuit 111 as control means for controlling the shutter opening and closing and an opening/closing drive circuit 130 as liquid crystal shutter drive means for driving the switch shutter. Thus, the control signal output from the shutter control means 110 controls the opening and closing of the switch shutter device 18 as shutter means. The reference signal is supplied from the reference signal generating circuit 2 to the opening/closing drive circuit 130 to produce a drive signal for driving the switch shutter device 18.

Figure 7:
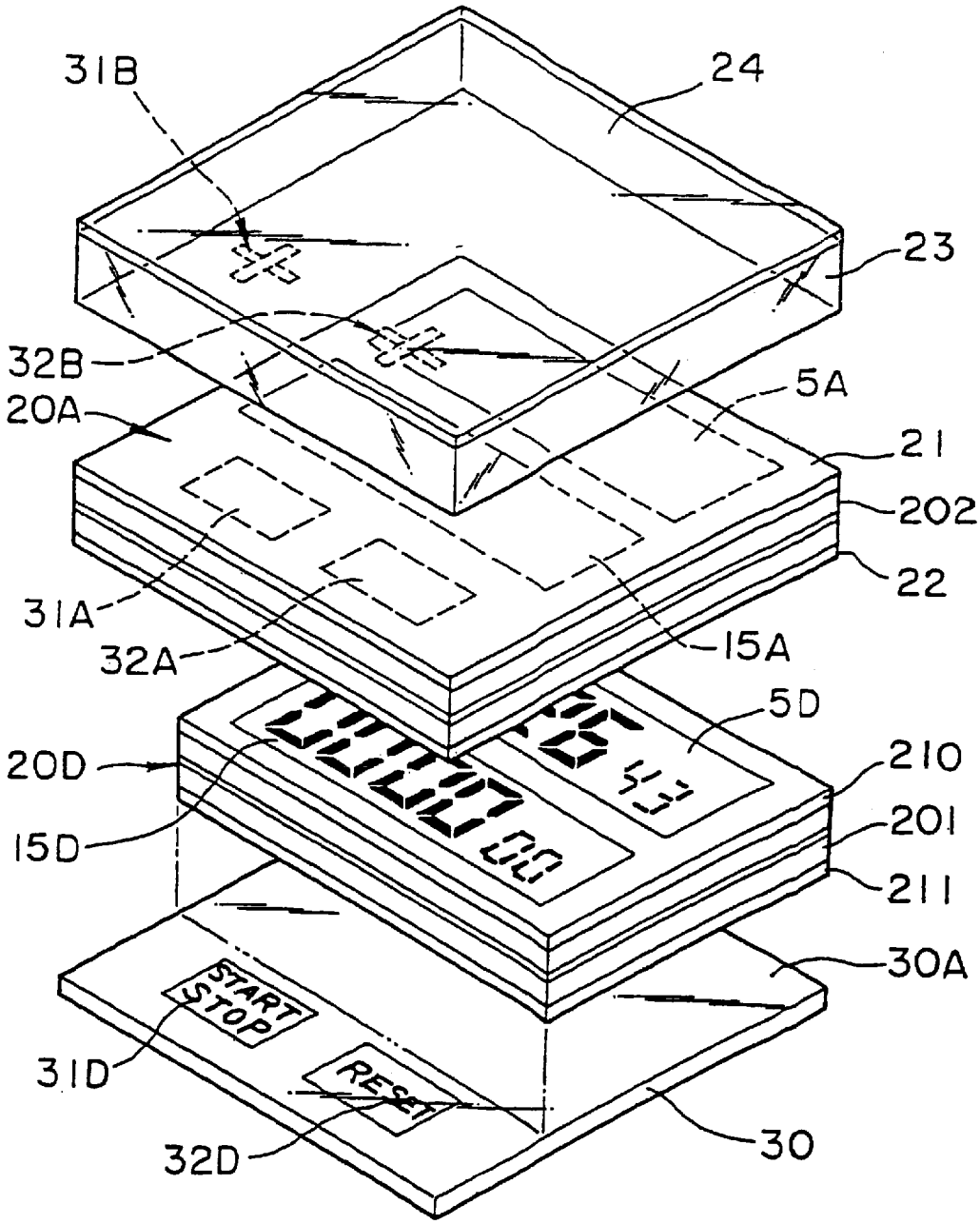
FIG. 7 is a perspective diagram schematically showing the structure of the display section of the small electronic device of FIG. 5.

A liquid crystal shutter panel 20A configuring the switch shutter device 18 has an absorptive polarizing plate 21 and a reflective polarizing plate 22 laminated to include therebetween a liquid crystal cell 202 which has a time information shutter window 5A, a chronograph information shutter window 15A, a start/stop switch window 31A and a reset switch windows 32A segmented as shown in FIG. 7.

Using the switch shutter device 18 of the shutter section B2, when the same switch means 9 as in the first embodiment generates a switching signal, the time information shutter window 5A, the chronograph information shutter window 15A, the start/stop switch windows 31A and the reset switch window 32A, which are segmented on the liquid crystal cell 202 of the liquid crystal shutter panel 20A, are put into a display state by the application of a voltage. Thus, time information and chronograph information displayed on the time display section 5D and the chronograph display section 15D of the display device 17 positioned underneath become visible through the glass 23.

Switch members 31, 32 for the operation, step and zero reset of the chronograph information generating circuit 15 will be described with reference to FIG. 7. Transparent electrodes are mounted so as to have substantially a cross form in a plan view on the top surface of the glass 23 and the bottom surface of a transparent touch panel 24. By pushing the pertinent portion of the transparent touch panel 24, both the electrodes are mutually contacted to provide detector sections 31B, 32B for detecting switching.

Switch characters 31D, 32D are formed by printing or the like on a reflection surface 30A of a reflection plate 30, the detector sections 31B, 32B, the switch windows 31A, 32A and the switch characters 31D, 32D are arranged to have their shapes matched in a plan view. Therefore, when the time display section 5D and the chronograph display section 15D are indicated, the switch windows 31A, 32A of the liquid crystal shutter panel 20A, which make the switch characters 31D, 32D have a display state (shutter open state) by the application of a voltage, are transmitted by the reflected light of the reflection plate 30 at the same time. The detector sections 31B, 32B held between the glass 23 and the touch panel 24 also transmitted by the reflected light become visible as the switch members 31, 32. By pressing the detector sections 31B, 32B of the touch panel 24, the switch is turned on to operate the chronograph information generating circuit 15.

From the opening/closing control circuit 111 of the shutter control means 110, a control signal for opening or closing the switch shutter device 18 is output to the opening/closing drive circuit 130, and a power saving control signal for controlling the power saving of the entire system to be put in the display shutout state is output to the first display drive means 61 and the second display drive means 62.

In the display shutout state, the power saving control signal is output, and the first display drive means 61 and the second display drive means 62 as the liquid crystal drivers stop the operation to output the display drive signal according to the power saving control signal. Thus, the liquid display operation according to the display drive signal is stopped and put into a power saving state. The power consumption of the entire system is thus decreased. In other words, the power consumption is decreased by stopping the display drive means 60 as the liquid crystal driver, and the power consumption is further decreased by stopping the operation of the liquid crystal display.

Figure 8:
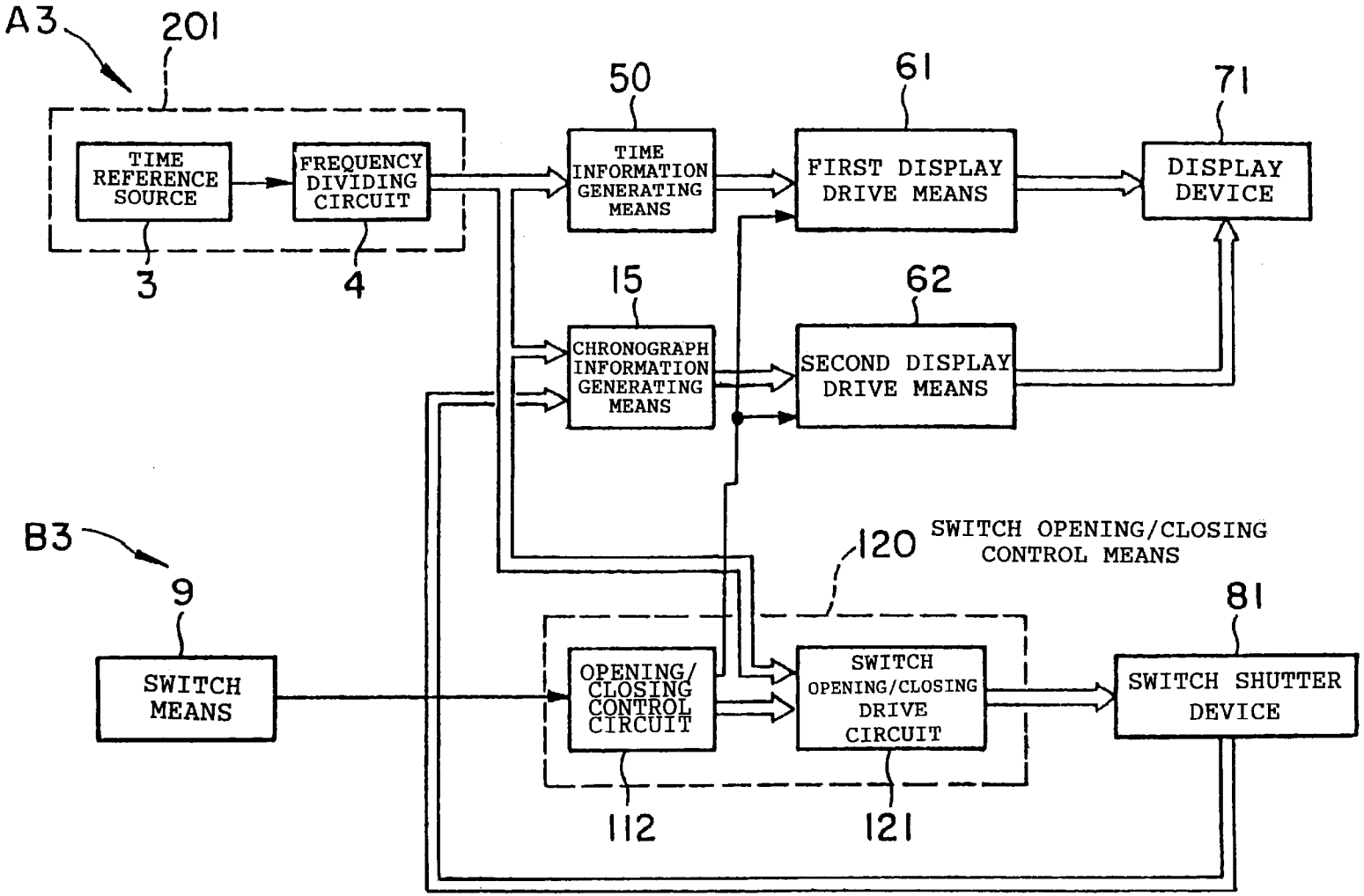
FIG. 8 is a system block diagram of a fourth embodiment of small electronic device according to the invention.
Figure 9:
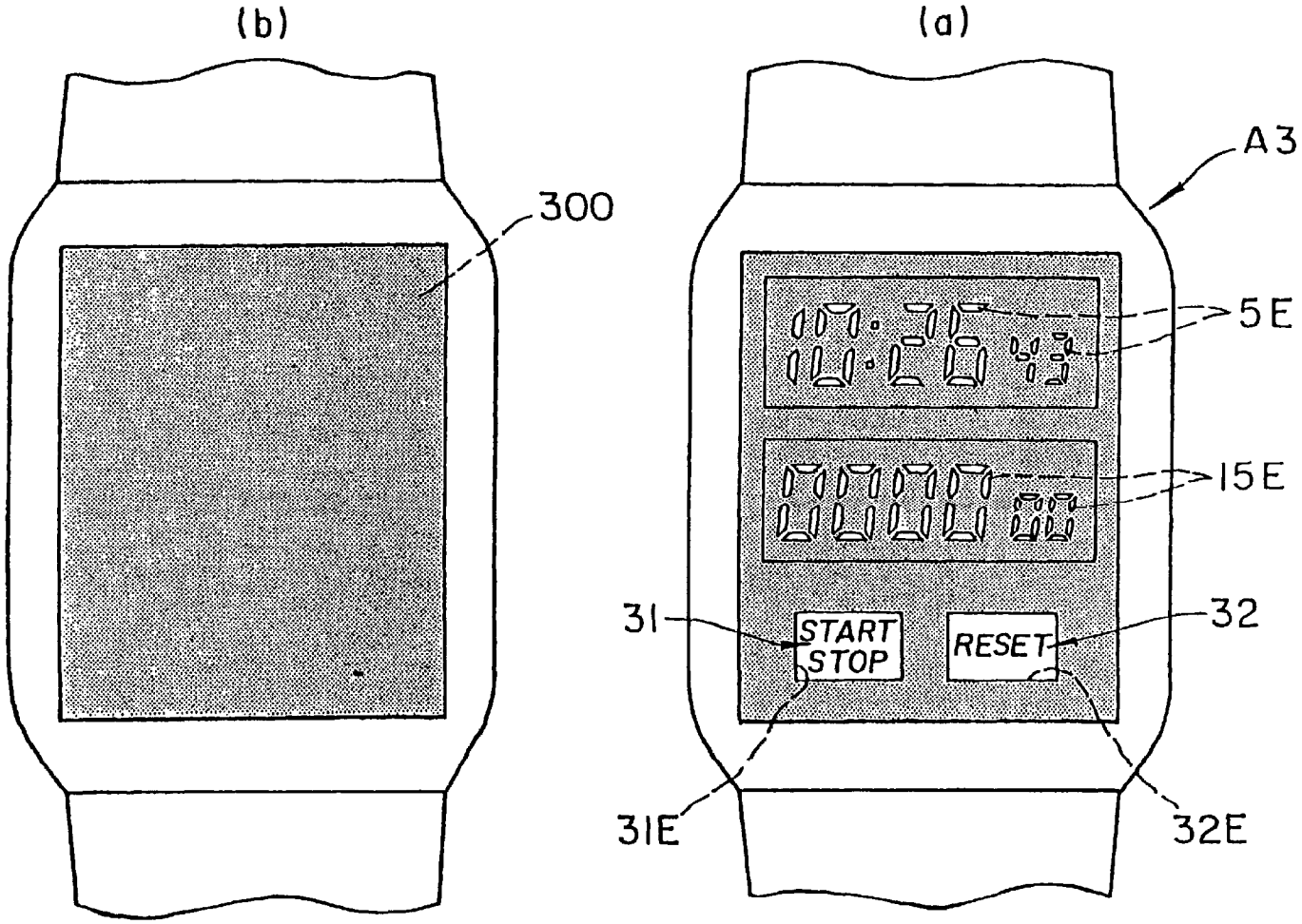
FIG. 9 is a plan diagram showing the small electronic device of FIG. 8, (a) is a plan diagram showing the device with the shutter open, and (b) is a plan diagram showing the same with the shutter closed.

A fourth embodiment of the small electronic device according to the present invention is shown in FIG. 8 through FIG. 10.

FIG. 8 is a system block diagram showing the fourth embodiment of the small electronic device according to the invention. FIG. 9(*a*) is a plan diagram showing the small electronic device with its shutter open. FIG. 9(*b*) is a plan diagram showing the small electronic device with its shutter closed. FIG. 10 is a schematic diagram showing the structure of a display section of the small electronic device.

The fourth embodiment of the small electronic device will be described with reference to a digital quartz watch A3. As shown in FIG. 10, this embodiment has substantially the same structure as the third embodiment except that a single layer liquid crystal panel is used in this embodiment to provide the same effects as the two-layered liquid crystal panel used in the third embodiment. Therefore, the same reference numerals as in the third embodiment are used and their descriptions will be omitted in this embodiment.

A switching signal output from a switch means 9 is input as a control signal to a switch opening/closing control means 120 as the display shutout control means which comprises an opening/closing control circuit 112 as the control means for controlling the opening and closing of the switch shutter and a switch opening/closing drive circuit 121 as the liquid crystal shutter drive means for driving the switch shutter and output as a control signal for controlling the shutter opening and closing of a switch opening/closing device 81 as shutter means. A predetermined reference signal is supplied from the reference signal generating means 201 to the switch opening/closing circuit 121 to produce a drive signal for driving the switch opening/closing device 81.

As shown in FIG. 9 and FIG. 10, according to the time information generating means 50 and a chronograph information generating means 15, a display segment 5E of a time information generating means 50 and a display segment 15E of a chronograph information generating means 15 which are formed on a liquid crystal cell 200 in an inverted state (negative state) from the segment display as in the third embodiment become transparent and transmit the reflected light from a reflection surface 30A of the reflection plate 30 to make the display information visible.

Switch members 31, 32 for the operation, stop and zero reset of the chronograph information generating means 15 become visible as the reflected light transmits through switch windows 31E, 32E of a liquid crystal display shutter panel 300 having switch characters 31D, 32D which are displayed by the application of a voltage and through detector sections 31B, 32B which are interposed between glass 23 and a touch panel 24. In the same way as in the third embodiment, the switch is turned on by pushing the detector sections 31B, 32B of the touch panel 24 to operate the chronograph information generating means 15.

From the opening/closing control circuit 112 of the switch opening/closing control means 120, a control signal for opening and closing the switch shutter device 18 is output to the switch opening/closing drive circuit 121 and a power saving control signal for controlling the power saving of the entire system to be output to a display shutout state are output to the first display drive means 61 and the second display drive means 62.

In the display shutout state, the power saving control signal is output, the first display drive means 61 and the second display drive means 62 as the liquid crystal drivers stop the operation to output the display drive signal according to the power saving control signal, and the liquid crystal display operation according to the display drive signal is stopped and put in a power saving state. Thus, the power consumption of the entire system can be decreased. In other words, the power consumption is decreased by stopping the display drive means 60 as the liquid crystal drive, and the power consumption is further decreased by stopping the operation of the liquid crystal display.

As shown in FIG. 10, either the absorptive polarizing plate 21 or the reflective polarizing plate 22 is fixed and the other polarizing plate is rotated, so that transmission axis X of the absorptive polarizing plate 21 and transmission axis X of the reflective polarizing plate 22 are parallel to each other at an angle 0 degree. In a state where no voltage is applied to the liquid crystal cell with a twisted nematic (TN) liquid crystal cell 200 to be twisted by 90 degree interposed therebetween, a reflection characteristic is exhibited, and when a voltage is applied, a transmittance characteristic is exhibited. Therefore, in the state with no voltage applied, a lustrous reflection characteristic is obtained by the external light source, and a shutter having a metallic luster can be configured by the incidence of light through the glass 23 of the watch. The same action and effect as described above can also be obtained when both the polarizing plates are reflective polarizing plates.

In the first to fourth embodiments described above, the absorptive polarizing plate 21 was used as the upper polarizing plate and the reflective polarizing plate 22 was used as the lower polarizing plate. However, it is to be understood that both the upper and lower polarizing plates can be the reflective polarizing plate 22, and the reflective polarizing plate 22 can be used as the upper polarizing plate and the absorptive polarizing plate 21 as the lower reflector plate.

INDUSTRIAL APPLICABILITY

As described above, the small electronic device according to the present invention is suitable for use with wristwatches, compact calculators, portable telephones and other small portable electronic devices.

What is claimed is:

1. A small electronic device comprising:

an information generating means;

a display drive means for outputting a display drive signal according to a signal from the information generating means;

a display device for generating an information display according to an output signal from the display drive means;

a shutter means for selectively permitting viewing of said information display, such that said information display is visible through said shutter means in a display state, and wherein said information display is not visible through said shutter means in a display shutout state;

a timer control means for performing timer counting action on the basis of an output signal from an outside switch means; and a display shutout control means for switching said small electronic device between said display state and said display shutout state, wherein said display drive means is controlled by a signal from the display shutout control means and wherein the display shutout control means is controlled according to a signal from said outside switch means and a time-out signal from said timer control means, and wherein the display drive means is adapted to stop the operation according to the control from the display shutout control means in the display shutout state.

2. The small electronic device according to claim 1, wherein the shutter means is a liquid crystal shutter means using liquid crystal.

3. The small electronic device according to claim 2, wherein said liquid crystal shutter means comprises a reflective polarizing plate.

4. The small electronic device according to any one of claims 1 through 3, wherein information from the information generating means is time information, an information display section formed on the display device is a pointer type watch for indicating time information using hands according to time information from the information generating means.

5. The small electronic device according to claim 4, further comprising an information restoring means for controlling information about elapsed time of the display shutout state continuing before restoring to the time information display state, wherein upon restoring to the time information display state, the information restoring means is configured to drive the hands of the pointer type watch to indicate the present time according to the information about the elapsed time of the information restoring means.

6. The small electronic device according to claim 5, wherein the information restoring means starts counting, according to the control made by the display shutout control means, when the time information display state is switched to the display shutout state, keeps as elapsed time information a value counted until the counting operation is stopped when the time information display state is restored, also produces a restoring drive signal for the restoring drive according to the counted value, and supplies the restoring drive signal to the display drive means.

7. The small electronic device according to claim 6, wherein the restoring drive signal is a fast forwarding drive signal with a drive signal appearing a cycle faster than an ordinary drive signal.

8. A small electronic device comprising:

an information generator;

a display driver for outputting a display drive signal according to a signal from the information generator;

a display device for generating an information display according to an output signal from the display driver;

a shutter for selectively permitting viewing of said information display, such that said information display is visible through said shutter in a display state, and wherein said information display is not visible through said shutter in a display shutout state;

a timer controller for performing timer counting action on the basis of an output signal from an outside switch; and a display shutout controller for switching said small electronic device between said display state and said display shutout state, wherein said display driver is controlled by a signal from the display shutout controller, and wherein the display shutout controller is controlled according to a signal from said outside switch and a time-out signal from said timer controller, and wherein the display driver is adapted to stop the operation according to the control from the display shutout controller in the display shutout state.

9. The device of claim 8, wherein the shutter is a liquid crystal shutter using liquid crystal.

10. The device of claim 9, wherein said liquid crystal shutter comprises a reflective polarizing plate.

11. The device of claim 8, wherein information from the information generator is time information, an information display section formed on the display device is a pointer type watch for indicating time information using hands according to time information from the information generator.

12. The device of claim 11, further comprising an information restoring unit for controlling information about elapsed time of the display shutout state continuing before restoring to the time information display state, wherein upon restoring to the time information display state, the information restoring unit is configured to drive the hands of the pointer type watch to indicate the present time according to the information about the elapsed time of the information restoring unit.

13. The device of claim 12, wherein the information restoring unit starts counting, according to the control made by the display shutout controller, when the time information display state is switched to the display shutout state, keeps as elapsed time information a value counted until the counting operation is stopped when the time information display state is restored, also produces a restoring drive signal for the restoring drive according to the counted value, and supplies the restoring drive signal to the display driver.

14. The device of claim 13, wherein the restoring drive signal is a fast forwarding drive signal with a drive signal appearing a cycle faster than an ordinary drive signal.

* * * * *